United States Patent [19]

Beasley

[11] 4,369,720

[45] Jan. 25, 1983

[54] TUFTING LOOPER APPARATUS WITH OPPOSED CLIP SUPPORT

[75] Inventor: Max M. Beasley, Chattanooga, Tenn.

[73] Assignee: Tuftco Corporation, Chattanooga, Tenn.

[21] Appl. No.: 291,256

[22] Filed: Aug. 10, 1981

[51] Int. Cl.[3] ..... D05C 15/36

[52] U.S. Cl. ..... 112/79 A; 112/79 R

[58] Field of Search ..... 112/79 R, 79 FF, 79 A

[56] References Cited

U.S. PATENT DOCUMENTS 3,138,126 6/1964 Card ..... 112/79 R 4,155,319 3/1979 Short ..... 112/79 R 4,241,673 12/1980 Bardsley ..... 112/79 A 4,241,676 12/1980 Parsons et al. ..... 112/79 A 4,245,574 1/1981 Wilson ..... 112/79 R

*Primary Examiner*—Ronald Feldbaum

*Attorney, Agent, or Firm*—Harrington A. Lackey

[57] ABSTRACT

A looper apparatus for a multiple-needle tufting machine, and particularly for a narrow gauge tufting machine, including transversely spaced loopers or hooks and a plurality of corresponding spring clips or looper clips mounted on a clip support spaced in front of the hooks, and mounted to reciprocate with said hooks, so that only the clamping portions of said clips engage only the corresponding free end portions of the hooks.

6 Claims, 9 Drawing Figures

PATTERN CONTROLLED YARN FEED

TUFTING LOOPER APPARATUS WITH OPPOSED CLIP SUPPORT

BACKGROUND OF THE INVENTION

This invention relates to tufting machines, and more particularly to a looper apparatus for a multiple-needle tufting machine adapted to form loop pile and cut pile in the same row of stitching.

In multiple-needle tufting machines having conventional gauges of 3/16" or greater, loop pile and cut pile have been formed in the same row of stitching by looper apparatus, such as that disclosed in the Card U.S. Pat. No. 3,084,645, issued Apr. 9, 1963.

In the prior Card patent, the looper apparatus includes a hook having a smooth, pointed bill extending in the direction opposite from the direction of the fabric feed. A looper clip is fixed to the needle side of each hook and extends along, but is laterally spaced from and below the lower or bottom edge of, the hook, and then terminates in a free end or clamp portion biased into engagement against the free or pointed end portion of the hook. In the prior Card patent, the speed of the yarn fed to the needles is selectively controlled by a pattern control mechanism. Normal lengths of yarn are fed to the needles for making a normal-length loop pile which is secured and held upon the bill of the looper apparatus and subsequently cut by a knife to form a normal length cut-pile tuft. On the other hand, when the pattern control mechanism starves the yarn feed, tension is applied to the yarn caught on the hook. As the hook retracts, the yarn forces the clamping end of the looper clip way from the bill so that the loop is released and shortened, but is not cut, to thereby form a shorter uncut pile loop.

However, since the trend in the tufting industry is to employ more narrow needle gauges for forming tufted fabrics, such as carpet, the hooks, looper clips and knives become more crowded, as the gauge of the needles is reduced. Where the gauge is reduced to 5/32 of an inch, the knives must be set with more care, thereby requiring more time, so that the looper clips will not interfere with the knives.

When the gauge is reduced to ⅛ of an inch, the setting of knives becomes critical. When the gauge is reduced to 1/10" or less production of tufting fabrics including loop pile and cut pile in the same row of stitching formed by adjacent hooks, knives and looper clips, becomes extremely difficult.

Where the gauge is so narrow, the looper clips of one looper interferes with the knife of the adjacent looper.

Several attempts have been made to provide looper apparatus including various types of clip construction and supports to provide ample room for the hooks, knives and clips in the more narrow or fine gauge tufting machines. Some examples of these looper and clip arrangements are found in the following U.S. patents:

| | | |
|---|---|---|
| 4,103,629 | Card | Aug. 1, 1978 |
| 4,155,319 | Short | May 22, 1979 |
| 4,241,675 | Bardsley | Dec. 30, 1980 |
| 4,241,676 | Parsons et al | Dec. 30, 1980 |

It will be noted in all of the looper apparatus recited in the above U.S. patents that the looper clips are fixed or attached directly to the loopers or hooks, and in most instances directly to the intermediate body portion or neck of the hook.

Therefore, in all the devices, except the looper apparatus disclosed in the above Bardsley U.S. Pat. No. 4,241,675, the overall width of the looper apparatus is increased by the thickness of the body of the looper clip. At least some portion of all the looper clips extend above, below, or in close proximity to the entire length of the bill of the hook, so that if the clip becomes bent, sprung or disoriented, within the limited space afforded, defective tufting operations will result.

SUMMARY OF THE INVENTION

It if therefore an object of this invention to provide a looper apparatus for a multiple-needle tufting machine, and particularly for a narrow gauge tufting machine, for forming loop pile and cut pile in the same row of stitching, which avoids the above-enumerated problems.

In the looper apparatus for a loop/cut pile tufting machine, made in accordance with this invention, generally the same type of hooks and knives are used as are employed in conventional tufting machines, such as those disclosed in the prior U.S. Card Pat. No. 3,084,645, the Card Pat. No. 4,103,629, and the Short Pat. No. 4,155,319.

However, each looper clip associated with a corresponding hook has been substantially modifiifed to avoid striking or otherwise interfering with the knife cooperating with an adjacent loop hook.

The looper clip made in accordance with this invention still includes a basic mounting portion connected to a free end or clamp portion biased into engagement with the needle side of the free end or pointed end portion of the hook bill. However, instead of clips being mounted to extend generally parallel to, and in the same direction as, the bills of the corresponding hooks, the clips are mounted in a clip support in front of the hook bills to extend in the opposite direction toward the hooks. Accordingly, no portion of the clip, except the clamp portion engaging the free end portion of the hook bill, is in the immediate vicinity of any part of the hooks or the knives. Therefore, even if the looper clips are bent, sprung, or otherwise transversely distorted, they will not strike any of the knives or interfere with the knife paths. Furthermore, no portion of the clip, except the clamp portion, will occupy any of the space between the adjacent hooks.

The looper clip support is connected by linkage, such as rocker arms, to the hook bar, so that the clips and hooks reciprocate simultaneously as a unit.

DESCRIPTION OF THE PREFERRED EMBODIMENTS

Figure 1:
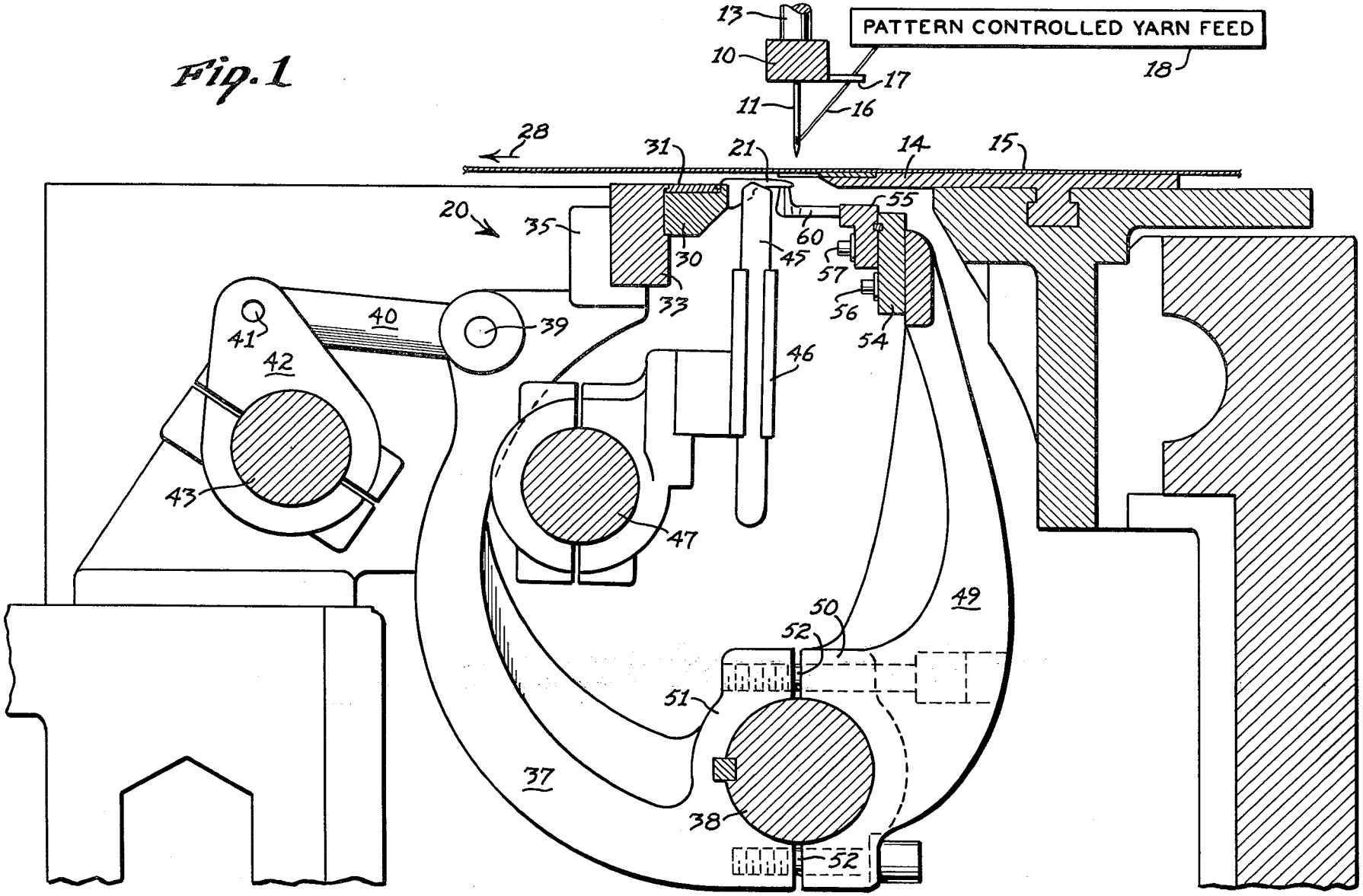
FIG. 1 is a fragmentary, sectional elevation of a portion of a multiple-needle tufting machine having in-line needles and disclosing the looper apparatus made in accordance with this invention in a cutting position.

Referring now to the drawings in more detail, FIG. 1 discloses a typical transverse needle bar 10 supporting a plurality of transversely spaced in-line needles 11 of a uniform gauge for vertical reciprocating movement in a multiple-needle tufting machine. The needle bar 10 is adapted to be reciprocally moved by a conventional needle drive mechanism, not shown, through push rods 13, between a lower position, such as that disclosed in FIG. 3, penetrating the base fabric 15, and an upper position, such as that disclosed in FIGS. 1 and 5, above the base fabric 15.

It will be understood that the needle bar 10 could support a pair of transversely spaced rows of staggered needles, in a conventional manner, if desired.

Supported upon the needle plate 14 for movement longitudinally from front to rear in a feeding direction through the tufting machine is the base fabric 15. Each needle 11 carries a yarn 16 through the base fabric 15 upon each stroke of the needle bar 10. The yarn 16 is fed to the respective needles 11 from a conventional yarn supply, not shown, through yarn feed rolls, not shown, and yarn guide means, such as the yarn guide 17 fixed to the needle bar 10. The yarns 16 are controlled by a pattern controlled yarn feed apparatus 18, of any conventional construction and function, such as that shown in the Card Pat. No. 3,084,645.

The pattern control yarn feed apparatus 18 is adapted to selectively reduce the speed of the yarn 16 fed to the corresponding needles 11 in order to starve the yarn feed, and create additional tension in the corresponsing yarn 16.

The looper apparatus 20 made in accordance with this invention includes a plurality of hooks 21, each hook having a shank 22, an intermediate neck portion 23, throat 24, and a bill 25 projecting forward, from the neck portion 23. The bill 25 terminates in a substantially pointed free end portion 26 and has a lower substantially straight cutting edge 27. The free end portion 26 of the bill 25 points forward, or in a direction opposite to the fabric feed direction, illustrated by the arrow 28.

The shanks 22 of the hooks 21 are secured in corresponding slots 29 of the transverse hook bar 30 by a transverse cap plate 31 and threaded set screws 32, as illustrated in more detail in the co-pending patent application Ser. No. 276,885 of Max M. Beasley, filed June 24, 1981, for MODULAR LOOPER APPARATUS FOR NARROW GAUGE TUFTING MACHINE. The hook bar 30 is also secured to a transverse back-up bar 33 by bolts 34. Other types of hook bar support structures may also be used.

The back-up bar 33, or back-up bar sections, are supported by a plurality of transversely spaced brackets 35 forming the upper ends of corresponding arcuate looper rocker arms 37, the lower ends of which are fixed to the transverse reciprocal looper shaft 38.

Each rocker arm 37 is pivotally connected by a pivot pin 39 to a link arm 40, the opposite end of which is pivotally connected by pivot pin 41 to a jack shaft rocker arm 42 fixed to a jack shaft 43. The jack shaft 43 is driven in a reciprocal rotary motion, by conventional means, not shown, operatively linked to the reciprocal needle drive means, also not shown.

Each of the looper hooks 21 is adapted to cooperate with a corresponding knife 45 mounted in a knife holder 46 fixed to the reciprocal knife shaft 47. The knife shaft 47 is also reciprocally driven by linkage, not shown, operatively connected to the same drive mechanism for the jack shaft 43 and the needle drive mechanism, so that the needles 11, hooks 21 and knives 45 reciprocate in synchronism through various operative positions, some of which are shown in FIGS. 2–5.

The mechanism thus far described in multiple-needle tufting machines is known in the art.

As disclosed in FIG. 1, a second, or clip-supporting, rocker arm 49 of generally arcuate shape opposing each of the looper rocker arms 37 is fixed to the looper shaft 38. As disclosed in FIG. 1, the lower end of the rocker arm 49 constitutes a C-shaped clevis 50 opposing and adapted to be securd to a C-shaped clevis 51 forming the lower end of the looper rocker arm 37. Both clevises 50 and 51 are held together and in fixed relationship upon the looper shaft 38 by bolts 52. In this manner, both rocker arms 37 and 49 are fixed together and to the looper shaft 38 for simultaneous reciprocal motion as a unit. Preferably, there are as many clip-supporting rocker arms 49 as there are looper rocker arms 37 spaced transversely along the looper shaft 38.

The upper end of each rocker arm 49 is fixed to a transverse support plate 54, upon which is mounted one or more clip support bars or clip support bar modules or sections 55. The transverse support plate 54 is secured to the upper end of the rocker arm 49 by bolts 56, while the clip support bar, or bars, 55 is fixed to the support plate 54 by means of bolts 57.

Fixed in transverse spaced relationship in the clip support bar 55 are a plurality of looper clips or spring clips 60. The transverse spacing of the clips 60 is the same as the needle gauge or the spacing between the loop hooks 21.

Each of the clips 60 includes an elongated mounting portion 61 forming one end portion of the clip 60 and a clamping portion 62 forming the other end portion of the clip 60.

As disclosed in the drawings, the clip support bar 55 is located forwardly of, and slightly downward from, each corresponding hook 21. The mounting portion 61 of each clip 60 is fixedly secured, by any convenient means, in a corresponding one of a plurality of transversely spaced slots 63 formed in the clip support bar 55, or the mounting portions 61 may be molded in place in an integral cast modular clip support bar 55, if desired.

The clips 60 are mounted in the clip support bars 55 in such a manner that each clamping portion 62 projects rearwardly from its mounting portion 61, and projects upward to bear against the needle face of the free end portion 26 of each corresponding loop hook 21. In other words, the clamping portion 62 engages the opposite face of the hook bill 25 from the face engaging the knife 45.

Figures 2, 3, 4, 5, 6, 7, 8, 9:
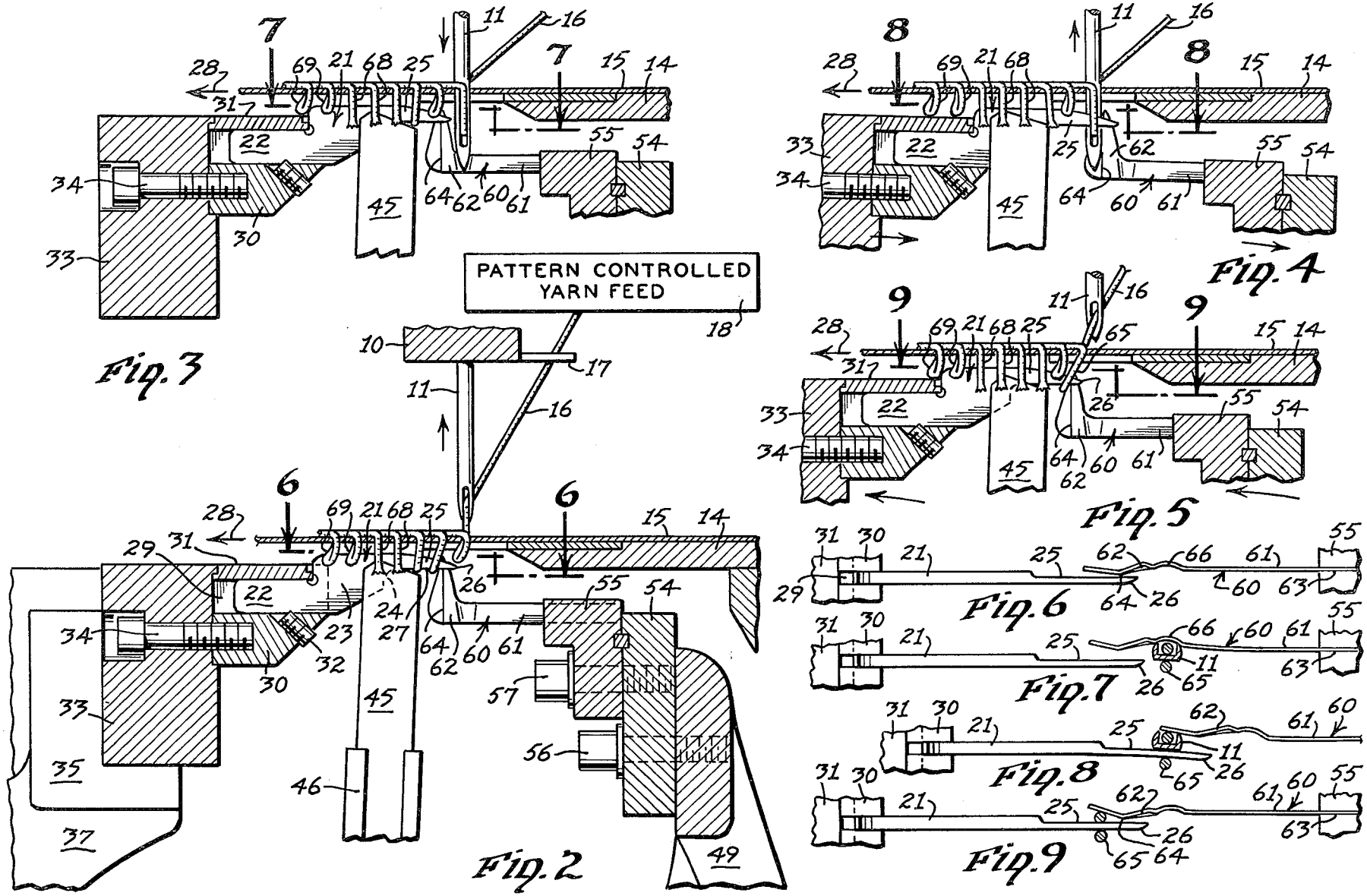
FIG. 2 is an enlarged, fragmentary, sectional elevation of the looper apparatus and needle in an operative position in which a low loop has just been formed.
FIG. 3 is a view similar to FIG. 2 of the looper apparatus and needle in a second operative position.
FIG. 4 is a view similar to FIG. 3, illustrating the looper apparatus and needle in a subsequent third operative position.
FIG. 5 is a view similar to FIG. 4 in which the looper apparatus and needle are in a subsequent fourth operative position.
FIG. 6 is a fragmentary sectional plan view taken along the line 6—6 of FIG. 2.
FIG. 7 is a fragmentary sectional plan view taken along the line 7—7 of FIG. 3.
FIG. 8 is a fragmentary sectional plan view taken along the line 8—8 of FIG. 4.
FIG. 9 is a fragmentary sectional plan view taken along the line 9—9 of FIG. 5.

The clamping portion 62 preferably has a vertical crease shape, in a similar manner to other prior art spring slips, to form a convex crease edge 64 adapted to bear against the adjacent needle face or surface of the free end portion 26 of the corresponding hook 21, as best illustrated in FIG. 6.

The clip 60 is preferably made of spring steel, but in any event, has sufficient elasticity that it can be diverted or cammed laterally by its engagement with the descending needle 11, as illustrated in FIGS. 3 and 7. Each clip 60 will also yield to a backdrawn yarn constituting a part of a loop 65 formed on the hook bill 25, when sufficient tension is exerted in the yarn 16 by the pattern controlled yarn feed apparatus 18, as best illustrated in FIGS. 5 and 9.

The looper clip 60 may be formed to have an intermediate arcuate cammed surface 66 (FIGS. 6 and 7) to facilitate engagement by the descending needle 11. Yet the elasticity of the spring clip 60 is such that its crease edge 64 will remain engaged with the opposed face of the bill 25 normally to hold loops upon the bill 25 until the loops have moved to the closed end of the hook 21 where they are cut by the reciprocating knife 45, in a well known manner, to form cut pile tufts 68.

Thus, as in previous tufting machines incorporating loop/cut apparatus including hooks, knives, and spring clips, cut pile tufts 68 of a predtermined height will normally be formed by the looper apparatus when the yarn 16 is not starved by the pattern controlled yarn feed apparatus 18, and loops 69 of lower height will be formed when the yarn 16 is starved by the pattern controlled yarn feed apparatus 18 to rob, strip or withdraw the loops from the bills of the loop hooks 21.

As illustrated in the drawings, the only part of the loop clip 60 engaging any part of the hook 21 is the upper part of the clamping portion 62 contacting the free end portion 26 of the hook 21 along the creased edge 64. On the other hand, the looper clip 60 is supported in such a manner as to move continuously and reciprocally with the loop hook 21 as a unit. In other words, the creased clamping portion 62 normally engages the same surface of the needle face of the free end portion 26 regardless of the reciprocal position of the loop hook 21. This unitary motion is obtained because of the fixed relationship between the clips 60 and the hooks 21 through the above-described structural linkage components. Thus, the movement of the clips 60 completely avoids any spaces within which the hooks 21 and knives 45 operate.

Moreover, in view of the limited reciprocal motion of the knives 45 relative to their corresponding loop hook 21, that is within a reciprocal cutting area adjacent the throats 24 of the respective hooks 21, the clamping portions 62 of each of the clips 60 is always located in a position spaced forward of the forwardmost edge of the knife 45. Accordingly, regardless of the reciprocal positions of the knives 45 and the clips 60, no portion of the clips 60 ever strikes any of the transversely aligned knives 45.

Furthermore, because the clip supports are spaced forward of the looper hooks 21 so that the clips 60 project rearwardly, that is in the opposite direction from the direction they have normally projected in prior art loop/cut devices, all portions of the clips 60 and clip supporting apparatus, except the crease edges 64 bearing against the corresponding hooks 21, are completely removed from the limited spaces between the hooks 21 and the knives 45.

By virtue of this removal of practically the entire clip and clip support structure from interference with the looper hooks and knives, more room is available for occupation by the hooks and knives alone, particularly for narrow gauge, multiple-needle tufting machines.

What is claimed is:

1. In a tufting machine having means for supporting the base fabric for longitudinal movement in the feeding direction through said machine, a plurality of transversely spaced reciprocal needles for introducing yarns through the base fabric to form loops, means for selectively controlling the length of a yarn fed to each of said needles, looper apparatus comprising:

(a) a hook for each needle cooperating with said corresponding needle to form a loop thereon, (b) each of said hooks having a shank and a bill projecting longitudinally from said shank and terminating in a free end portion, (c) reciprocal hook bar means supporting said hooks transversely spaced apart with said free end portions extending in the direction opposite said feed direction, (d) a knife for each hook, (e) knife supporting means supporting said knives transversely so that each knife cooperates with the bill of the corresponding hook for cutting a loop on said bill, (f) a looper clip for each hook having a mounting portion and a clamp portion, (g) clip support means securing said mounting portions so that said clips oppose said corresponding hooks and each of said clamp portions projects from said mounting portion in said feeding direction and is biased to normally engage said free end portion of said corresponding bill to normally hold the loops formed on said bill, but yieldable to predetermined yarn tension in a loop on said bill to force said clamp portion away from said bill to permit said tensioned loop to be withdrawn from the free end of said hook to form an uncut loop, and (h) means connecting said clip support means to said reciprocal hook bar means for unitary movement of said clips and said hooks.

2. The invention according to claim 1 in which said clip support means comprises a clip bar means in which the mounting portions of said clips are fixed, said clip bar means being spaced from said hooks in the direction opposite said feeding direction.

3. The invention according to claim 1 in which said clamp portion comprises a generally vertical crease portion defining a vertical convex edge normally engaging the free end portion of said corresponding hook.

4. The invention according to claim 2 in which said clip bar means comprises an elongated transversely extending clip bar and in which the mounting portions of said clips are fixed in the same transverse spaced relationship as said corresponding hooks.

5. The invention according to claim 4 in which said reciprocal hook bar means comprises an elongated transverse reciprocal looper shaft, link means connecting said clip bar to said looper shaft, so that said clips and said corresponding hooks are reciprocally moved as a unit in cooperation with the reciprocal needles.

6. The invention according to claim 5 in which said looper shaft is mounted below said hook bar means and said knife supporting means, a looper arm fixedly connected to said hook bar means and said looper shaft, and a clip arm fixed to said clip bar and said looper shaft.

* * * * *